US011363386B1

(12) United States Patent
Huang et al.

(10) Patent No.: US 11,363,386 B1
(45) Date of Patent: Jun. 14, 2022

(54) SYSTEM FOR CONVERTING VIBRATION TO VOICE FREQUENCY WIRELESSLY

(71) Applicant: NATIONAL APPLIED RESEARCH LABORATORIES, Taipei (TW)

(72) Inventors: Chun-Ming Huang, Hsinchu (TW); Tay-Jyi Lin, Chiayi County (TW)

(73) Assignee: National Applied Research Laboratories, Taipei (TW)

( * ) Notice: Subject to any disclaimer, the term of this patent is extended or adjusted under 35 U.S.C. 154(b) by 0 days.

(21) Appl. No.: 17/109,665

(22) Filed: Dec. 2, 2020

(51) Int. Cl.
*H04R 17/02* (2006.01)
*G10L 19/04* (2013.01)

(52) U.S. Cl.
CPC ..... *H04R 17/02* (2013.01); *G10L 19/04* (2013.01)

(58) Field of Classification Search
CPC ..... H04R 17/00; H04R 17/02; H04R 21/02; H04R 1/222; H04R 1/14; H04R 1/46; H04R 19/016; H04R 2460/13; H04R 11/00; H04R 25/606; G10L 19/04
USPC ..... 381/173, 151
See application file for complete search history.

(56) References Cited

U.S. PATENT DOCUMENTS

2018/0084341 A1* 3/2018 Cordourier Maruri .. H04R 3/00

FOREIGN PATENT DOCUMENTS

TW 202029187 A 8/2020
WO WO-2020046098 A1 * 3/2020 ..... G10L 21/02

OTHER PUBLICATIONS

Office Action and Search Report for counterpart Taiwanese Application No. 109136166, dated Jun. 1, 2021.

* cited by examiner

*Primary Examiner* — Ahmad F. Matar
*Assistant Examiner* — Sabrina Diaz
(74) *Attorney, Agent, or Firm* — Rosenberg, Klein & Lee

(57) ABSTRACT

The present application discloses a system for converting vibration to voice frequency wirelessly and a method thereof. By sensing a first vibration variation data and a voice frequency variation data of a vocal vibration part in a first sensing period, a voice frequency reference data is obtained from the voice frequency variation data and the first vibration result. A second vibration result is obtained at a second sensing period for converting to a voice frequency output signal, and the voice frequency output signal is used to output as a voice signal corresponding to the voice frequency various result. Thus, the present application provides a voice signal close to a human voice.

7 Claims, 7 Drawing Sheets

SYSTEM FOR CONVERTING VIBRATION TO VOICE FREQUENCY WIRELESSLY

FIELD OF THE INVENTION

The present application relates generally to a device for converting voice frequency wirelessly, and particularly to a system for converting vibration to voice frequency wirelessly.

BACKGROUND OF THE INVENTION

Sound collecting devices have become one of the daily articles used by people most frequently. Devices such as mobile communication equipment, recording pens, and music players with recording function require high-quality sound collecting devices to receive external sound, particularly for the voices by people. In addition, various anti-noise methods are proposed for avoiding unclarity due to transmission over the air. In particular, when a user is moving, such as exercising, driving, violent activities, or in a noisy environment, sound collection will not be affected. Normal sound collecting devices include capacitive and piezoelectric sound collecting devices. For piezoelectric sound collecting devices, a piezoelectric device that can generate piezoelectric signals according to vibrations is attached to the human body for sensing the vibrations produced when the human body makes sound. The pressure produced by the vibrations is transmitted to the piezoelectric material, which generates voltage differences according to external pressure and becomes voltage signals for subsequent processing.

The sound collecting device according to the prior art is held manually or hanged around the neck to be close to the user's mouth for facilitating receiving the user's voice using an air-conductive microphone. Unfortunately, since the user needs to hold an air-conductive sound collecting device close to the user's mouth, it is difficult for the user to spare his hands. Although hang-type or desktop sound collecting devices allow a user to spare his hands, he still needs to adjust the location and angle of the sound collecting device. Besides, the air-conductive microphone hanging on a user's chest tends to swing according to the user's movement, influencing the user's activities and inducing inconvenience.

To overcome the problem of the air-conductive sound collecting devices as described above, a throat-vibrating sound collecting device is developed. The sound collecting device is disposed at the user's throat. The sound collecting device can receive the voice generated by the vibrations when the user speaks and uses the voice as the voice input of the computing device. Nonetheless, unclarity still occurs in vibration sound collecting devices. Accordingly, throat sound collecting devices are developed. Unfortunately, the small throat sound volume, which is conducted to the mouth part before emitting, leads the unclarity in throat sound collecting devices. Moreover, the throat sound signal and the vibration signal are different signal types, making their compensation difficult.

Accordingly, the present application provides a system for converting vibration to voice frequency wirelessly. The computing device generates voice-frequency reference data using a first vibration variation data and a voice frequency variation data in a first sensing period. According to the voice-frequency reference data, a second vibration variation data in the second sensing period is converted to a voice-frequency output signal. Thereby, a voice-frequency output signal close to the human voice can be provided.

SUMMARY

An objective of the present application is to provide a system for converting vibration to voice frequency wirelessly. By executing the application program in the computing device, a first vibration variation data and a voice frequency variation data are input to the computing device for generating voice-frequency reference data. Furthermore, a second vibration variation data is further converted to a voice-frequency output signal by the generated voice-frequency reference data. Thereby, a voice-frequency output signal close to the human voice can be provided.

The present application discloses a system for converting vibration to voice frequency wirelessly with intelligence learning capability, which comprises a sound collecting device and an computing device. The sound collecting device includes a vibration sensor, a voice frequency sensor, and a first wireless transmission unit. The computing device includes a processing unit, a storage unit, and a second wireless transmission unit. The vibration sensor senses a first vibration variation data of a throat part in a first sensing period and a second vibration variation data of the throat part in a second sensing period. The voice frequency sensor senses a voice frequency variation data of the throat part in the first sensing period. The first wireless transmission unit is unit connected to the computing device, the vibration sensor, and the voice frequency sensor. The storage unit stores an application program. The second wireless transmission unit is connected to the first wireless transmission unit. The processing unit executes the application program and receives the first vibration variation data and the voice frequency variation data via the first and second wireless transmission units for producing voice-frequency reference data according to the first vibration variation data and the voice frequency variation data. According to the above description, it is known that the computing device according to the present application can produce the corresponding voice-frequency reference data according to the first vibration variation data and the voice frequency variation data. Thereby, the artificial-intelligence application program can learn voice frequency and vibration conversion.

According to one embodiment of the present application, the application program includes an artificial intelligence algorithm and a voice frequency and vibration conversion program. The artificial intelligence algorithm is a deep neural network (DNN).

According to one embodiment of the present application, wherein the computing device converts the voice frequency variation data to a voice-frequency corresponding feature and the vibration variation data to a vibration corresponding feature. The voice-frequency corresponding feature and the vibration corresponding feature are the signal processing results for the log power spectrum, the Mel-frequency cepstrum (MFC), or the linear predictive coding (LPC) spectrum.

According to one embodiment of the present application, the vibration sensor is an accelerometer or a piezoelectric sensor.

The present application further discloses a system for converting vibration to voice frequency wirelessly, which comprises a sound collecting device and an computing device. The sound collecting device includes a vibration sensor, a voice frequency sensor, and a first wireless transmission unit. The computing device includes a processing unit, a storage unit, and a second wireless transmission unit. The vibration sensor senses a first vibration variation data of a throat part in a first sensing period and a second vibration variation data of the throat part in a second sensing period. The voice frequency sensor senses a voice frequency variation data of the throat part in the first sensing period. The first wireless transmission unit is unit connected to the computing device, the vibration sensor, and the voice frequency sensor. The storage unit stores an application program. The second wireless transmission unit is connected to the first wireless transmission unit. The processing unit receives the first vibration variation data and the voice frequency variation data via the first and second wireless transmission units. The computing device executes a voice frequency and vibration conversion program for converting the vibration variation data to a corresponding feature. The processing unit executes an artificial-intelligence application program and converts the vibration variation data of the corresponding feature to a voice-frequency mapping signal with a reference sound-field feature. The processing unit executes the voice frequency and vibration conversion program for converting the voice-frequency mapping signal of the corresponding feature to a voice-frequency output signal in an outputable format. According to the above description, it is known that the computing device according to the present application can produce the corresponding voice-frequency reference data according to the first vibration variation data and the voice frequency variation data. Then after the computing device receives the second vibration variation data, it refers to the voice-frequency reference data to convert the second vibration variation data to the voice-frequency output signal close to human voice.

According to another embodiment of the present application, the system for converting vibration to voice frequency wirelessly further comprises an output device, which is connected to the computing device, receives the voice-frequency output signal in an outputable format and outputs a voice signal according to the voice-frequency output signal.

According to another embodiment of the present application, the application program includes an artificial intelligence algorithm and a voice frequency and vibration conversion program. The artificial intelligence algorithm is a deep neural network (DNN).

According to an embodiment of the present application, the computing device converts the vibration variation data to a vibration corresponding feature, which is the signal processing results for the log power spectrum, the Mel-frequency cepstrum (MFC), or the linear predictive coding (LPC) spectrum.

According to another embodiment of the present application, the vibration sensor is an accelerometer or a piezoelectric sensor.

DETAILED DESCRIPTION

Since the current vibration sound collecting mechanism is unable to provide output signals with expected quality, the present application provides a system for converting vibration to voice frequency wireless and the method thereof to solve the problem.

Figure 1:
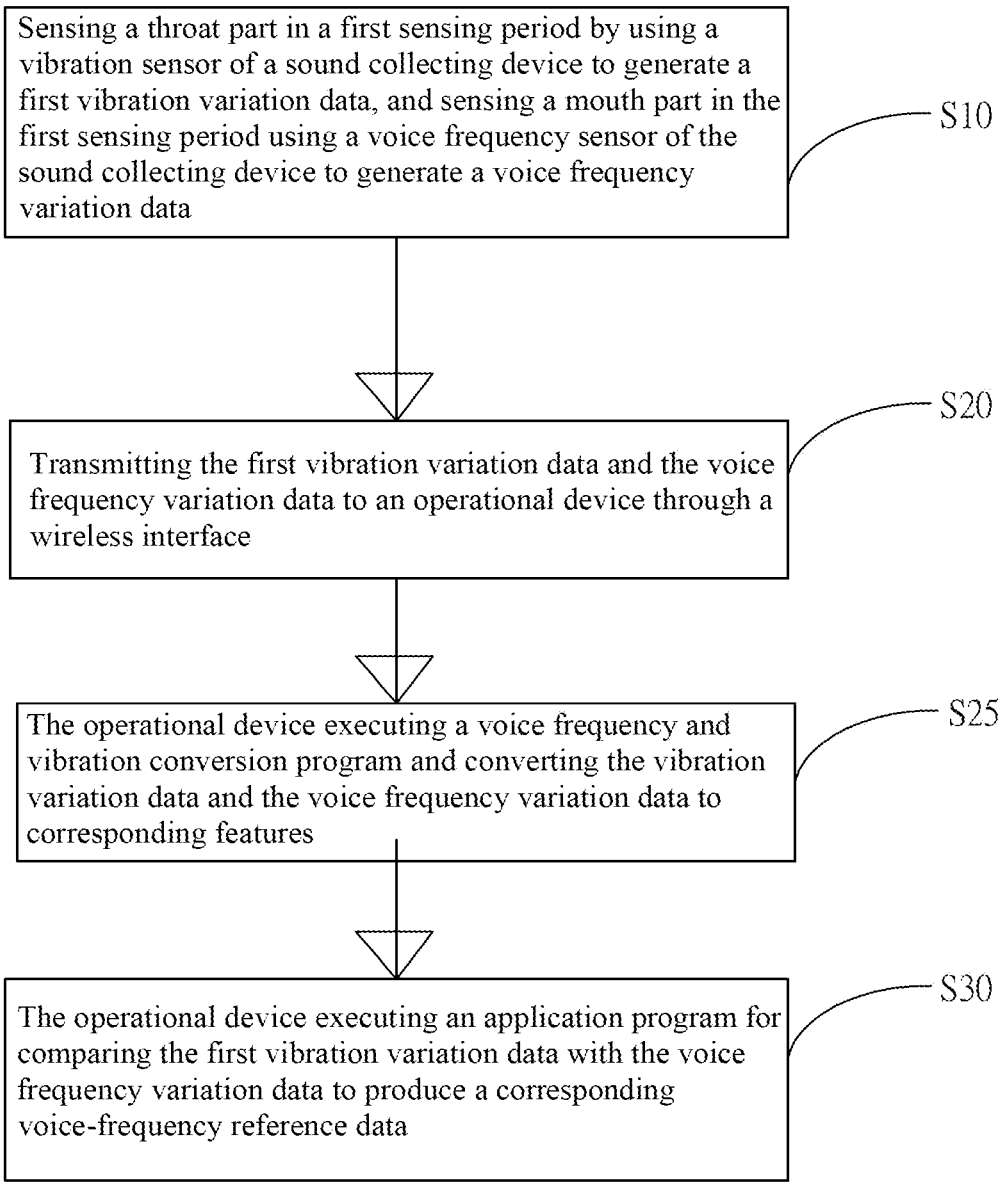
FIG. 1 shows a flowchart according to an embodiment of the present application.

First, please refer to FIG. 1, which shows a flowchart according to an embodiment of the present application. As shown in the figure, the method for converting vibration to voice frequency wirelessly according to the present application comprises steps of:

Step S10: Sensing a throat part in a first sensing period by using a vibration sensor of a sound collecting device to generate a first vibration variation data, and sensing a mouth part in the first sensing period using a voice frequency sensor of the sound collecting device to generate a voice frequency variation data;

Step S20: Transmitting the first vibration variation data and the voice frequency variation data to an computing device through a wireless interface;

Step S25: The computing device executing a voice frequency and vibration conversion program and converting the vibration variation data and the voice frequency variation data to corresponding features; and Step S30: The computing device executing an application program for comparing the first vibration variation data with the voice frequency variation data to produce a corresponding voice-frequency reference data.

Figure 2A:
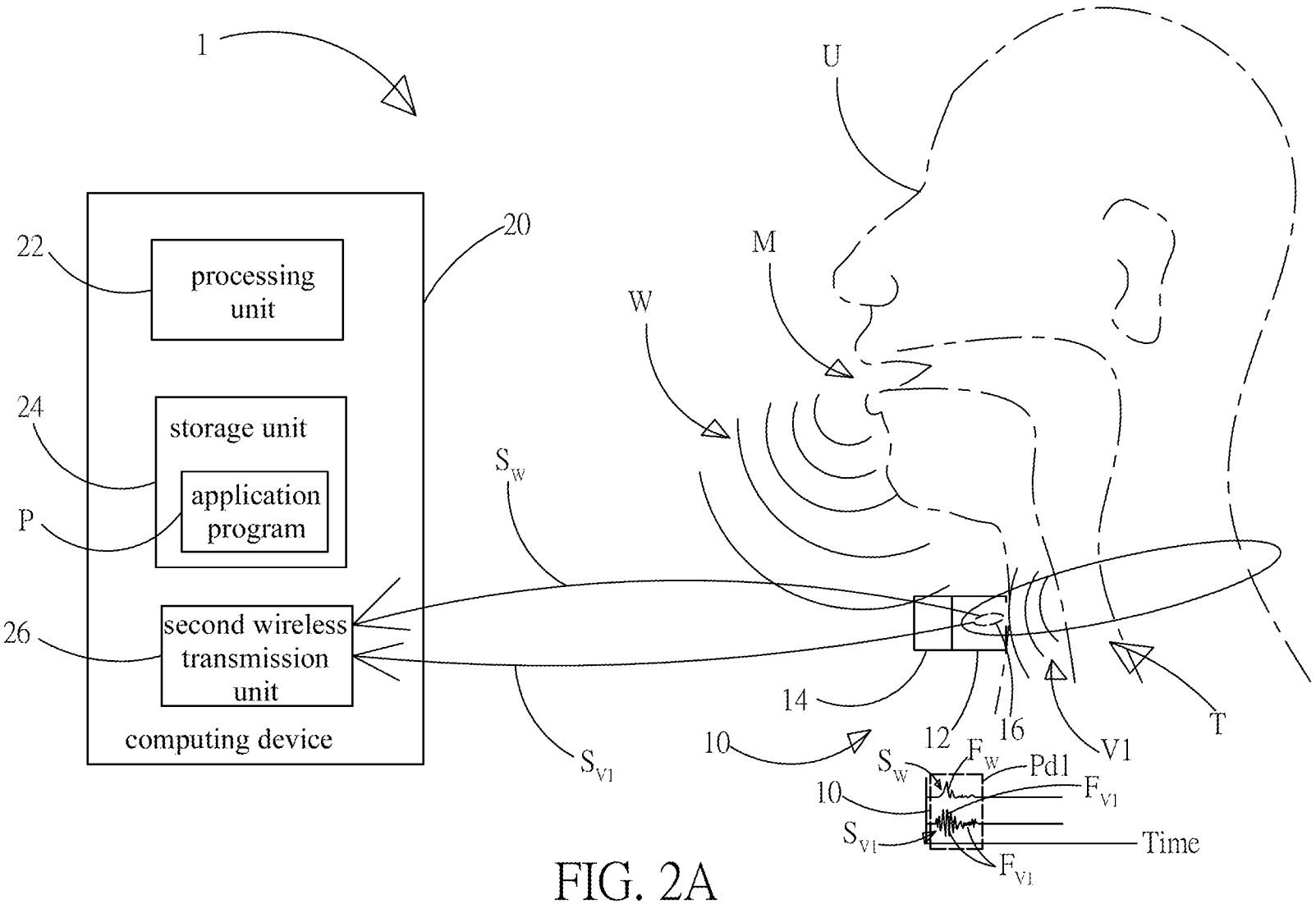
FIG. 2A shows a schematic diagram of sensing voice frequency and vibration simultaneously according to an embodiment of the present application.
Figure 2B:
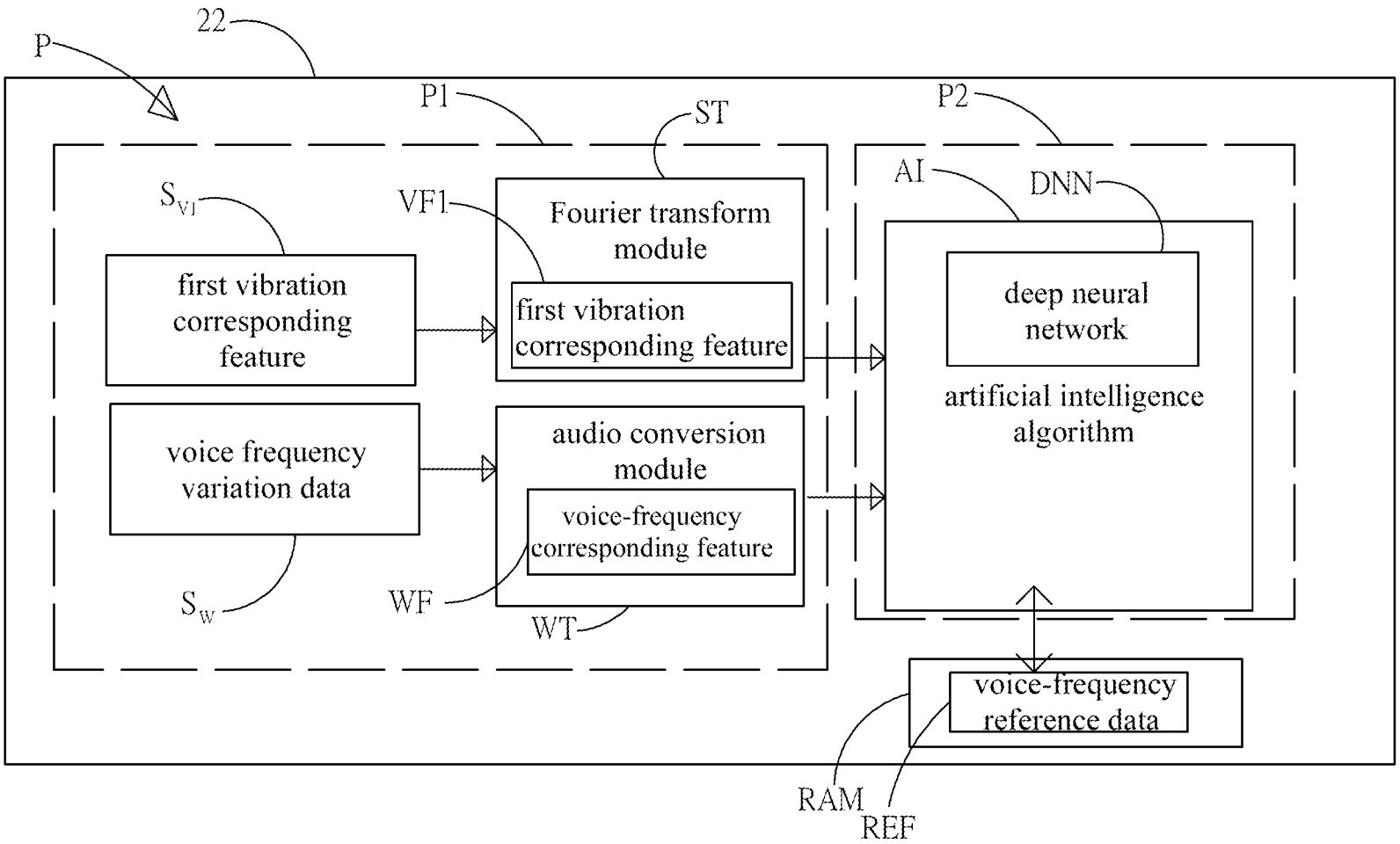
FIG. 2B shows a schematic diagram of calculating to give voice-frequency reference data according to an embodiment of the present application.

Please refer to FIG. 2A and FIG. 2B, which show a schematic diagram of sensing voice frequency and vibration simultaneously in the first sensing period and a schematic diagram of calculating to give voice-frequency reference data according to an embodiment of the present application. As shown in the figures, the system for converting vibration to voice frequency wirelessly 1 comprises a sound collecting device 10 and an computing device 20. The sound collecting device 10 includes a communication unit 12, a voice frequency sensor 14, and a first wireless transmission unit 16. The computing device 20 includes a processing unit 22, a storage unit 24, and a second wireless transmission unit 26. The storage unit 24 stores an application program P. The first wireless transmission unit 16 is connected to the second wireless transmission unit 26.

In the step S10, as shown in FIG. 2A, a user U wears the sound collecting device 10 at a throat part T by hanging or using a neck strap or a neck ring. When the user U give off sound, the throat part T generates vibration V1 correspondingly. The vibration V1 is conducted to the mouth part M and give off sound W. The vibration sensor 12 in the sound collecting device 10 senses a first vibration variation data $S_{V1}$ of the vibration V1 generated by the throat part T in a first sensing period Pd1. Meanwhile, the voice frequency sensor 14 of the sound collecting device 10 senses the sound W emitted from the mouth part M in the first sensing period Pd1 and produces a voice frequency variation data $S_W$ correspondingly. Next, in the step S20, as shown in FIG. 2A, the sound collecting device 10 transmits the first vibration variation data $S_{V1}$ and the voice frequency variation data $S_W$ to the computing device 20 via the wireless transmission interface (such as Bluetooth, Wi-Fi, ZigBee, or LoRa) formed by the first wireless transmission unit 16 and the second wireless transmission unit 26. In particular, the processing unit 22 stores the first vibration variation data $S_{V1}$ and the voice frequency variation data $S_W$ in the storage unit 24 temporarily.

In the step S25, as shown in FIG. 2B, the computing device 20 uses the processing unit 22 to load the application program P from the storage unit 24 to calculate the first vibration variation data $S_{V1}$ and the voice frequency variation data $S_W$ for producing voice-frequency reference data REF. The application program P includes a voice frequency and vibration conversion program P1 and an artificial intelligence module P2. The voice frequency and vibration conversion program P1 includes a Fourier transform module ST and an audio conversion module WT. The Fourier transform module ST performs Fourier transform for converting the first vibration variation data $S_{V1}$ to a first vibration corresponding feature VF1. The audio conversion module WT converts the voice frequency variation data $S_W$ to a voice-frequency corresponding feature. According to the present embodiment, the voice-frequency corresponding feature WF and the vibration corresponding feature VF1 are the log power spectrum (LPS). Besides, the voice-frequency corresponding feature WF and the vibration corresponding feature VF1 can further be the signal processing results for the Mel-frequency cepstrum (MFC) or the linear predictive coding (LPC) spectrum.

In the step S30, as shown in FIG. 2B, the artificial intelligence module P2 runs one or more artificial intelligence algorithm AI, for example, a deep neural network (DNN). Based on the same format, the artificial intelligence algorithm AI learns the correspondence between the voice-frequency corresponding feature WF and the first vibration corresponding feature VF1, namely, the weighting relation between the two, for producing the voice-frequency reference data REF correspondingly. In other words, the weighting relation between the voice-frequency corresponding feature WF and the first vibration corresponding feature VF1 is adopted as the voice-frequency reference data REF.

The method for converting vibration to voice frequency wirelessly as described above uses the computing device to execute the artificial-intelligence application program. By using the artificial intelligence algorithm, the corresponding weighting relation between the voice-frequency corresponding feature and the first vibration corresponding feature can be learned. The weighting relation can be used as the reference for the artificial intelligence algorithm to convert the vibration variation data to voice-frequency output data. In the method for converting vibration to voice frequency wirelessly according to the following embodiment, the received vibration variation data is converted to the corresponding voice-frequency output signal by using the artificial intelligence algorithm with reference to the learned voice-frequency reference data. The details will be described as follows.

Figure 3:
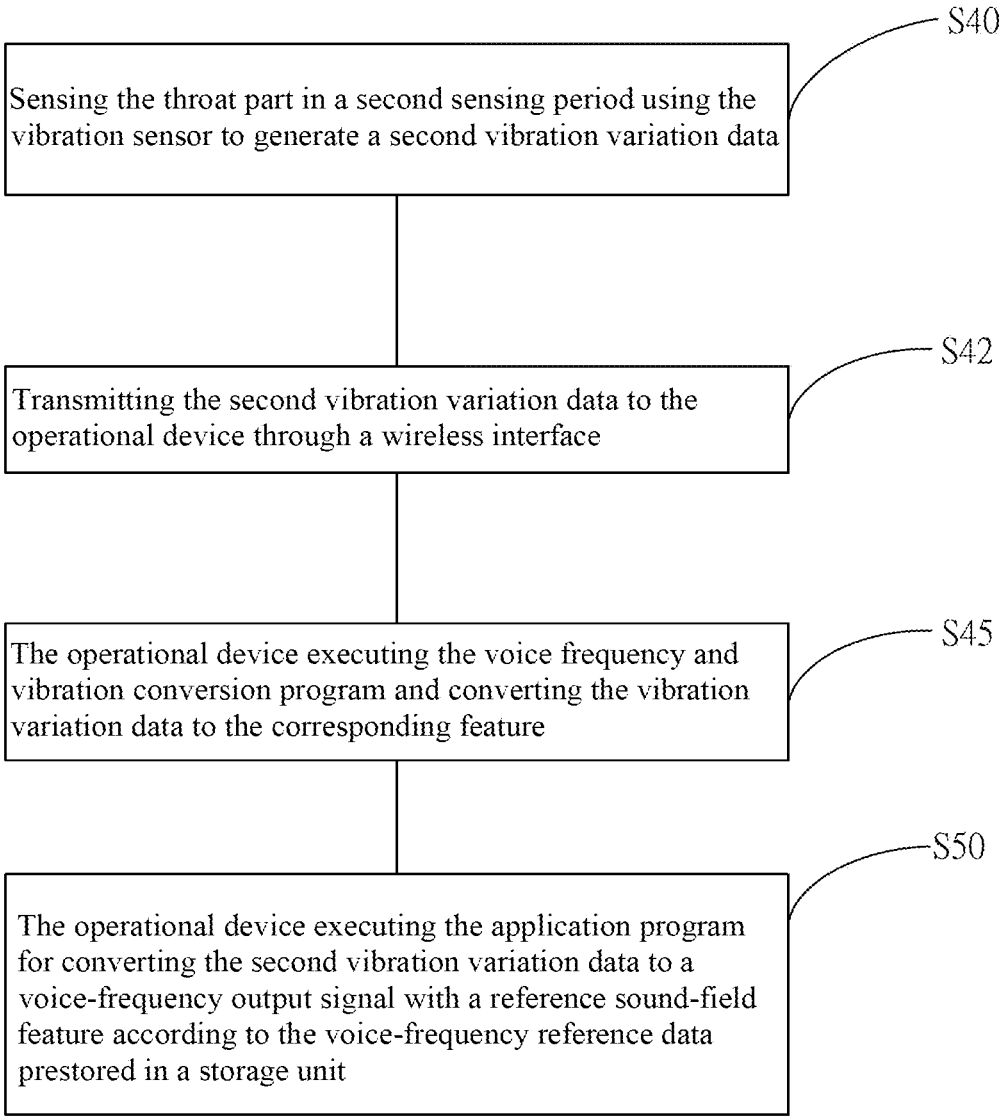
FIG. 3 shows a flowchart according to another embodiment of the present application.

Please refer to FIG. 3, which shows a flowchart according to another embodiment of the present application. As shown in the figure, the method for converting vibration to voice frequency wirelessly according to the present application comprises steps of:

Step S40: Sensing the throat part in a second sensing period using the vibration sensor and producing a second vibration variation data;

Step S42: Transmitting the second vibration variation data to the computing device;

Step S45: The computing device executing the voice frequency and vibration conversion program and converting the vibration variation data to the corresponding feature; and Step S50: The computing device executing the application program for converting the second vibration variation data to a voice-frequency output signal with a reference sound-field feature according to the voice-frequency reference data prestored in a storage unit.

Figure 4A:
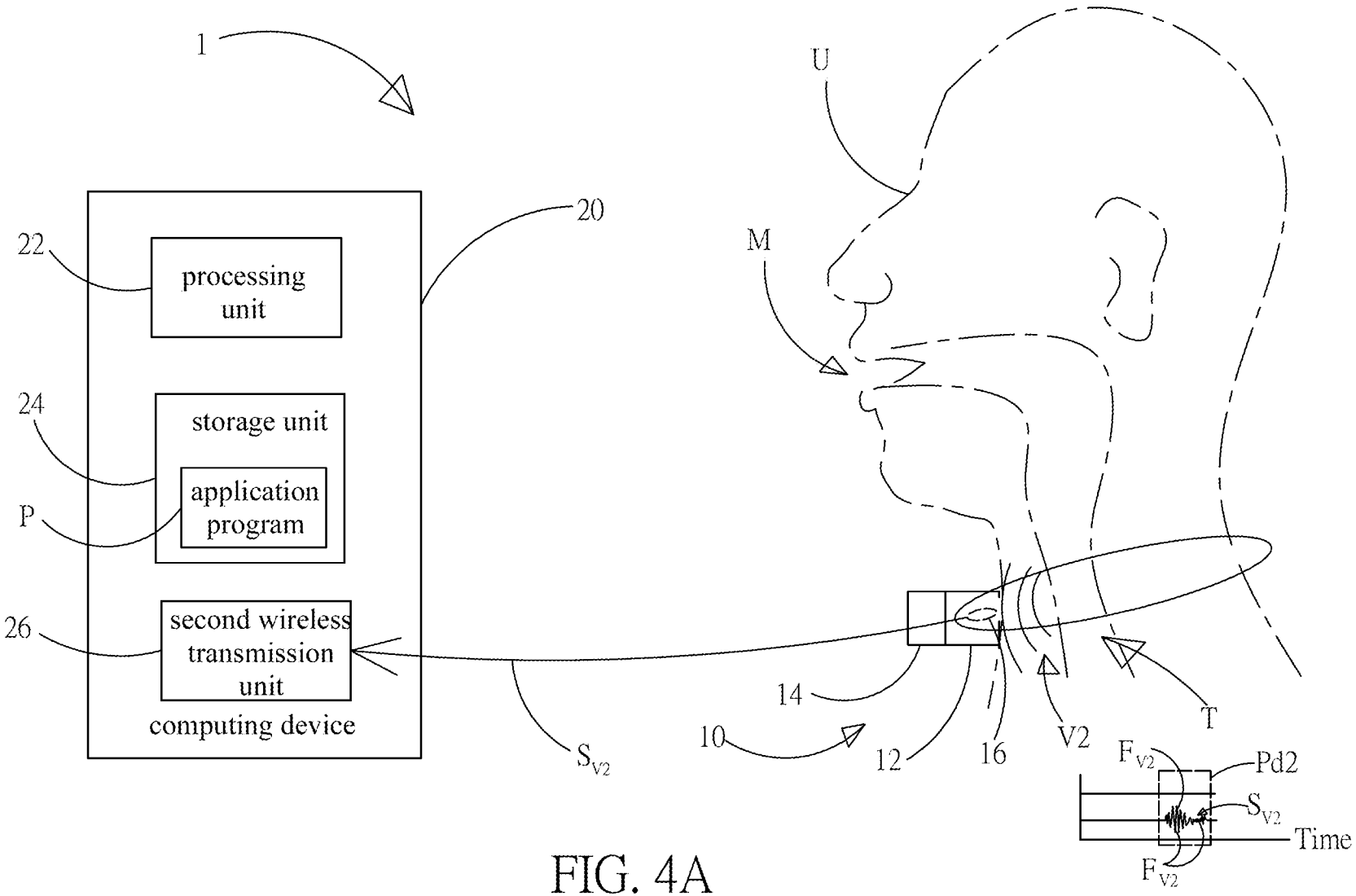
FIG. 4A shows a schematic diagram of sensing vibration according to another embodiment of the present application.

In the step S40, as shown in FIG. 4A, the vibration sensor 12 of the sound collecting device 10 senses the vibration V2 from the throat part T in the second sensing period Pd2 and giving a second vibration variation data $S_{V2}$. In the step S42, as shown in FIG. 4A, the second vibration variation data $S_{V2}$ is transmitted to the computing device 20 via the wireless transmission interface formed by the first wireless transmission unit 16 and the second wireless transmission unit 26. Furthermore, the processing unit 22 stores the second vibration variation data $S_{V2}$ received by the computing device 20 in the storage unit 24.

Figure 4B:
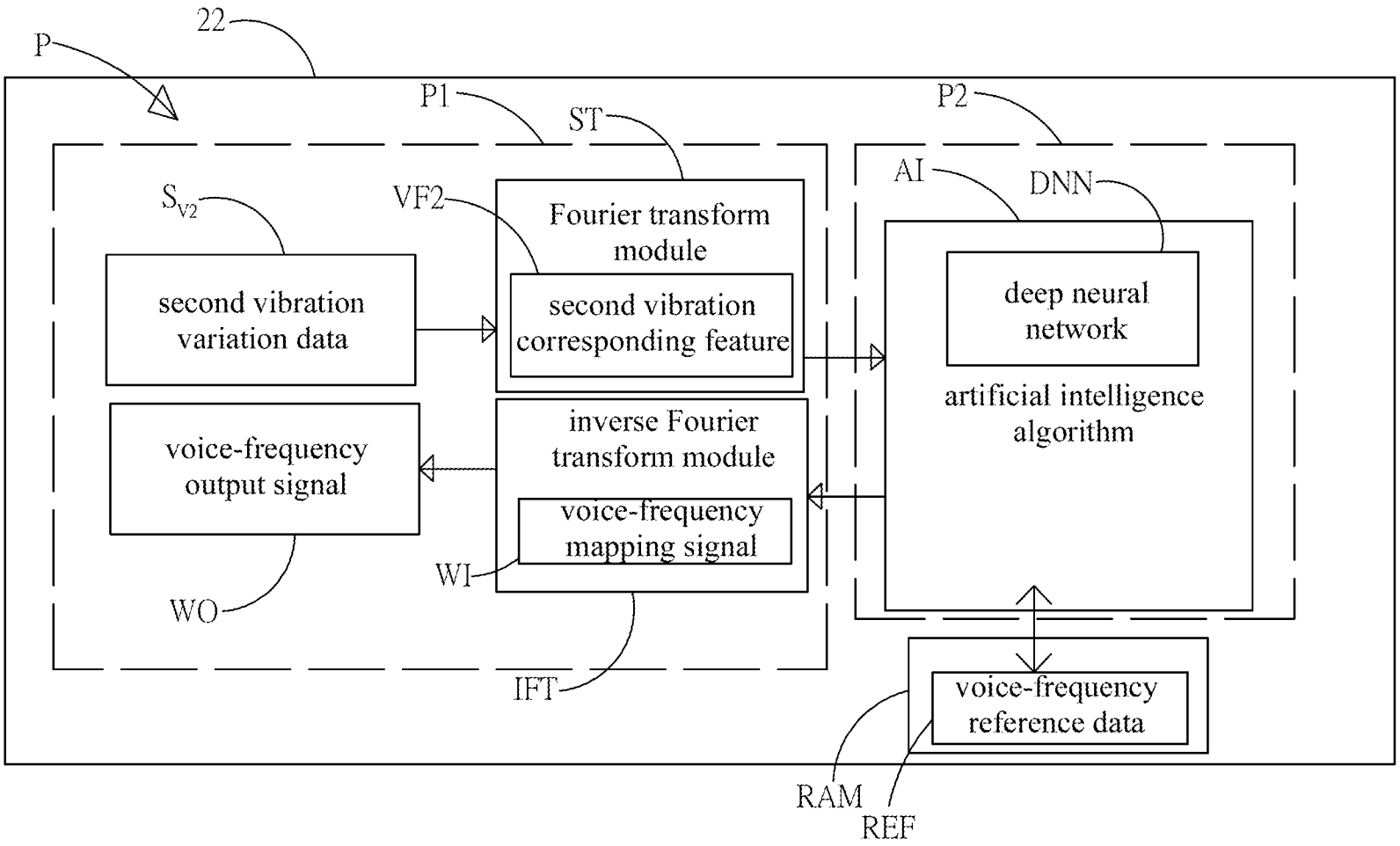
FIG. 4B shows a schematic diagram of converting vibration to voice frequency according to another embodiment of the present application.
Figure 4C:
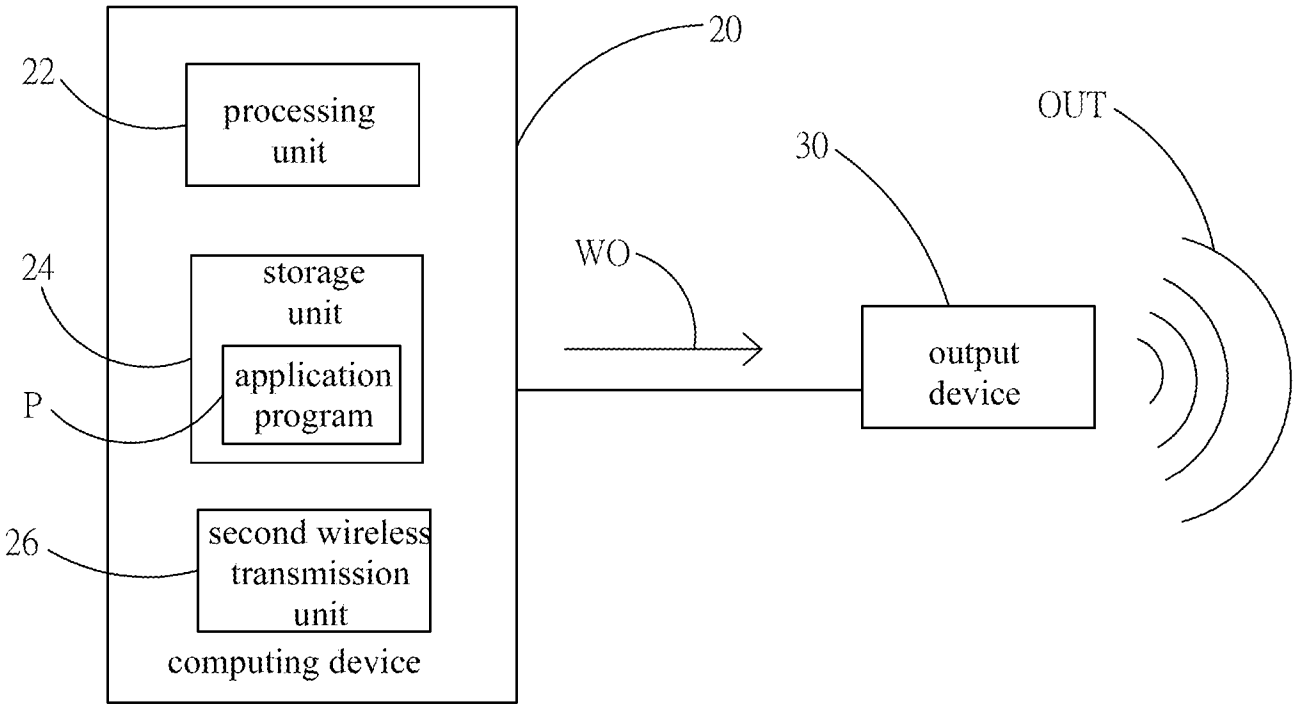
FIG. 4C shows a schematic diagram of outputting voice frequency according to another embodiment of the present application.

In the step S45, as shown in FIG. 4B, the processing unit 22 loads and executes the application program P stored in the storage unit 24. In addition, the processing unit 22 reads the second vibration variation data $S_{V2}$ for calculation in the application program P. The artificial intelligence algorithm AI executed by the processing unit 22 is to read the transformed second vibration variation data $S_{V2}$ performed by the Fourier transform module for converting the second vibration variation data $S_{V2}$ to a corresponding feature, namely, a second variation data corresponding feature VF2. According to the present embodiment, the second vibration corresponding feature VF2 is the log power spectrum (LPS). Besides, the second vibration corresponding feature VF2 can further be the signal processing results for the Mel-frequency cepstrum (MFC) or the linear predictive coding (LPC) spectrum. Next, in the step S50, as shown in FIG. 4B, the processing unit 22 converts the second vibration variation data $S_W$ to a voice-frequency mapping signal WI according to the artificial intelligence algorithm AI and the voice-frequency reference data REF prestored in the corresponding storage unit RAM, for example, the memory, of the processing unit 22. By using an inverse Fourier transform module IFT, the voice-frequency mapping signal WI can be converted to a voice-frequency output signal WO in an outputable format for subsequent outputting to an output device 30 such as a loudspeaker or an earphone. As shown in FIG. 4C, the voice-frequency output signal WO in an outputable format is output to the output unit 30 by the computing device 20 and thus outputting the output signal OUT close human voice.

Accordingly, the voice-frequency output signal WO according to the present application corresponds to the voice-frequency variation data $S_W$ extracted in the step S10. In other words, the computing device 20 according to the present application calculates to give the voice-frequency reference data according to the first vibration variation data $S_{V1}$ and the voice-frequency variation data $S_W$ acquired in the step S10. The voice-frequency reference data is then referred by the computing device 20 for converting the second vibration variation data $S_{V2}$ acquired subsequently to the voice-frequency output signal WO, which is an output signal OUT close to the human voice. Thereby, for the applications of converting the vibration signals from the throat part to audio signals, the present application can provide less-distorted audio signals.

To sum up, the present application provides a system for converting vibration to voice frequency wirelessly. The computing device according to the present application calculates the first vibration variation data and the voice frequency variation data sensed by the sound collecting device in the first sensing period and produces the corresponding voice-frequency reference data, which is used for training the computing device. Next, the second vibration variation data sensed in the second sensing period can be converted to the voice-frequency output signal corresponding to the voice frequency variation data. Thereby, the output signal close to human voice can be provided.

What is claimed is:

1. A system for converting vibration to voice frequency wirelessly with intelligence learning capability, comprising:

a sound collecting device, including:

a vibration sensor, sensing a vibration variation data of a throat part in a sensing period;

a voice frequency sensor, sensing a voice frequency variation data of said throat in said sensing period; and a first wireless transmission unit, connected to said vibration sensor and said voice frequency sensor;

a computing device, including:

a second wireless transmission unit, connected to said first wireless transmission unit wirelessly;

a processing unit, connected electrically to said first wireless transmission unit; and a storage unit, storing an artificial-intelligence application program and a voice frequency and vibration conversion program, said processing unit receiving said vibration variation data and said voice frequency variation data via said first wireless transmission unit and said second wireless transmission unit, said processing unit executing said voice frequency and vibration conversion program for converting said vibration variation data and said voice frequency variation data to two corresponding features, and said processing unit producing voice-frequency reference data according to said two corresponding features of said vibration variation data and said voice frequency variation data, said artificial-intelligence application program learning the weighting relation of said vibration variation data and said voice-frequency reference data for converting said vibration variation data to a voice-frequency output signal with reference to said learned voice-frequency reference data;

wherein said computing device converts said voice frequency variation data to a voice-frequency corresponding feature and said vibration variation data to a vibration corresponding feature; and said voice-frequency corresponding feature and said vibration corresponding feature are the signal processing results for the log power spectrum, the Mel-frequency cepstrum (MFC), or the linear predictive coding (LPC) spectrum, in same formats.

2. The system for converting vibration to voice frequency wirelessly of claim 1, wherein said application program includes an artificial intelligence algorithm; and said artificial intelligence algorithm is a deep neural network (DNN).

3. The system for converting vibration to voice frequency wirelessly of claim 1, wherein said vibration sensor is an accelerometer sensor or a piezoelectric sensor.

4. A system for converting vibration to voice frequency wirelessly, comprising:

a sound collecting device, including:

a vibration sensor, sensing a vibration variation data of a throat part in a sensing period; and a first wireless transmission unit, connected to said vibration sensor;

a computing device, including:

a second wireless transmission unit, connected to said first wireless transmission unit wirelessly;

a processing unit, connected electrically to said first wireless transmission unit; and a storage unit, storing an artificial-intelligence application program and a voice frequency and vibration conversion program, said processing unit receiving said vibration variation data via said first wireless transmission unit and said second wireless transmission unit, said processing unit executing said voice frequency and vibration conversion program for converting said vibration variation data to a corresponding feature, said processing unit executing said artificial intelligence application program for converting said vibration variation data of said corresponding feature to a voice-frequency mapping signal with a reference sound-field feature according to learned voice-frequency reference data prestored in said storage unit by learning the weighting relation of said vibration variation data and said voice-frequency reference data, and said processing unit executing said voice frequency and vibration conversion program for converting said voice-frequency mapping signal of said corresponding feature to a voice-frequency output signal in an outputable format;

wherein said computing device converts said vibration variation data to a vibration corresponding feature; and said vibration corresponding feature is the signal processing results for the log power spectrum, the Mel-frequency cepstrum (MFC), or the linear predictive coding (LPC) spectrum, as the same format as said voice-frequency reference data.

5. The system for converting vibration to voice frequency wirelessly of claim 4, further comprising an output device, connected to said computing device, receiving said voice-frequency output signal in an outputable format, and outputting a voice signal according said voice-frequency output signal in an outputable format.

6. The system for converting vibration to voice frequency wirelessly of claim 4, wherein said application program includes an artificial intelligence algorithm and a voice frequency and vibration conversion program; and said artificial intelligence algorithm is a deep neural network (DNN).

7. The system for converting vibration to voice frequency wirelessly of claim 4, wherein said vibration sensor is an accelerometer sensor or a piezoelectric sensor.

* * * * *